US008774678B2

(12) United States Patent
Seorl et al.

(10) Patent No.: US 8,774,678 B2
(45) Date of Patent: Jul. 8, 2014

(54) SUPPORTING COVER FOR AN IMAGE FORMING APPARATUS

(71) Applicant: Samsung Electronics Co., Ltd., Suwon-si (KR)

(72) Inventors: Kwoang Joe Seorl, Yongin-si (KR); Jae Myung Choi, Suwon-si (KR); Jin Ho Park, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/659,275

(22) Filed: Oct. 24, 2012

(65) Prior Publication Data

US 2013/0045025 A1 Feb. 21, 2013

Related U.S. Application Data

(63) Continuation of application No. 12/685,446, filed on Jan. 11, 2010, now Pat. No. 8,320,796.

(30) Foreign Application Priority Data

Jan. 14, 2009 (KR) ..... 10-2009-0002921

(51) Int. Cl.
*G03G 21/18* (2006.01)

(52) U.S. Cl.
CPC ..... *G03G 21/1842* (2013.01)
USPC ..... 399/114

(58) Field of Classification Search
USPC ..... 399/114
See application file for complete search history.

(56) References Cited

FOREIGN PATENT DOCUMENTS

JP 2007-322554 12/2007

OTHER PUBLICATIONS

Notice of Allowance, mailed Jul. 23, 2012, in corresponding U.S. Appl. No. 12/685,446 (12 pp.).

*Primary Examiner* — Walter L Lindsay, Jr.
*Assistant Examiner* — Ruth Labombard
(74) *Attorney, Agent, or Firm* — Staas & Halsey LLP

(57) ABSTRACT

Disclosed herein is an image forming apparatus including a main body; a developing unit detachably mounted on the main body and having a photoconductive medium; and a cover pivotably mounted on the main body to cover and support an outer end of the developing unit. The cover may have a latch engaged with the main body by one end thereof so that the cover supports the developing unit. A member that supports a shaft of the photoconductive medium may also be included. Because the member operates in association with the latch, opening and closing of the cover may be facilitated, accordingly also facilitating separation of the developing unit from the main body.

25 Claims, 8 Drawing Sheets

SUPPORTING COVER FOR AN IMAGE FORMING APPARATUS

CROSS-REFERENCE TO RELATED APPLICATION(S)

This application is a continuation application of application U.S. Ser. No. 12/685,446, filed Jan. 11, 2010 in the U.S. Patent and Trademark Office, which claims the benefit of Korean Patent Application No. 10-2009-0002921, filed on Jan. 14, 2009 in the Korean Intellectual Property Office, the entire disclosures of which are incorporated herein by reference.

TECHNICAL FIELD

Embodiments of the present disclosure generally relate to an image forming apparatus having a supporting cover capable of convenient removal of a detachable developing unit.

BACKGROUND OF RELATED ART

An image forming apparatus generally refers to an apparatus that produces an image on a recording medium, e.g., a sheet of paper, according to received image signals. Examples of an image forming apparatus may include a printer, a photocopier, a facsimile, or a multifunctional apparatus combining some of the functions of the afore-mentioned.

An image forming apparatus may generally comprise a main body that defines the overall exterior appearance thereof, a feeding unit that stores sheets of printing media (e.g., paper), a developing unit that forms a visible developer image on a photoconductive medium using developer (e.g., toner), a fixing unit that fixes the developer image on a printing medium and a discharging unit that discharges the printing medium, to which the image formation is completed, outside the image forming apparatus.

More specifically, during a typical image formation, an electrostatic latent image may be formed by exposing a charged photoconductive medium, which may be a part of the developing unit, with light, e.g., a laser beam. So formed electrostatic latent image may then be developed with developer, e.g., toner, into a visible image. Afterward, the visible image developed on the photoconductive medium may be transferred to the printing medium supplied from the feeding unit. By passing through the fixing unit, the image transferred to the printing medium is fixed to the printing medium, thus completing the image formation. After the image is fixed, the printing medium is discharged to the outside of the image forming apparatus through the discharging unit.

An image forming apparatus may include one or more components, for example, the developing unit, separably or detachably mounted on the main body so as to be replaceable with a new component. For example, the developing unit may be replaced when the supply of developer remaining therein is exhausted. When such a detachable developing unit is employed, the image forming apparatus may typically include a supporting cover that may be pivotably mounted on the main body, typically at the lower end portion thereof, to support the outer end of the developing unit and to thereby stabilize the developing unit mounted on the main body.

The supporting cover may comprise a latch and a supporting member. One end of the latch may be engaged with the main body to maintain a covered state of the developing unit. The supporting member may support a shaft of the photoconductive medium of the developing unit.

When separating the developing unit from the main body in the above-structured image forming apparatus, an external force may be applied to the supporting member to move the supporting member, thereby releasing the shaft of the photoconductive medium from the main body. Then, with an application of an additional external force, the latch may be released so that the supporting cover may be opened. As a result, opening of the supporting cover and the separating of the developing unit from the main body typically involves a set of complicated processes. A simpler operation of detaching a developing unit from the image forming apparatus is thus desirable.

SUMMARY OF THE DISCLOSURE

In accordance with one aspect of the present disclosure, an image forming apparatus may include a main body, a developing unit, a cover, a latch and a supporting member. The developing unit may be detachably received in the main body, and may have a photoconductive medium configured to support thereon a visible image. The cover may be pivotably mounted on the main body. The latch may be moveably coupled to the cover, and may have a first end thereof configured to engage with the main body to thereby maintain the cover in a covering position at which position the cover covers the developing unit received in the main body. The supporting member may be moveably coupled to the cover, and may be arranged to be moveable in association with a movement of the latch into a supporting position at which position the supporting member comes into a supporting contact with a shaft of the photoconductive medium of the developing unit.

The supporting member may be rotatably mounted on the cover, and may be configured to rotate between the supporting position and a releasing position at which position the supporting member is spaced apart from the shaft of the photoconductive medium. The latch may be movable substantially linearly, and may have a second end opposite the first end thereof capable of coming into an interfering contact with the supporting member such that the movement of the latch cause the supporting member to rotate.

The developing unit may comprise a plurality of developing units each received in the main body and each having a respective corresponding photoconductive medium configured to support thereon the visible image. The supporting member may comprise a plurality of supporting members each moveably coupled to the cover and each configured to move into the supporting position so as to support the photoconductive medium corresponding to a respective associated one of the plurality of developing units.

The image forming apparatus may further comprise a gear member coupled to the plurality of supporting members so that the supporting members move in association with movements of one another.

Each supporting member may comprise a hinge projection protruding from the supporting member. The gear member may define a plurality of hinge holes, at least one for each supporting member, into which the hinge projection of each of the plurality of supporting members may be rotatably received.

The second end of the latch may come into contact with a first one of the plurality of supporting members. The first one of the plurality of hinge holes of the gear member that receives the hinge projection of the first one of the plurality of supporting members has a width along a direction of the movement of the latch greater than a diameter of the hinge projection of the first one of the plurality of supporting members remaining ones of the plurality of hinge holes of the gear member may have respective widths along a longitudinal direction of the gear member greater than respective diameters of the hinge projections of respective associated ones of the plurality of supporting members.

The cover may defines an insertion hole into which the shaft of the photoconductive medium may be received. The insertion hole may have a first supporting portion arranged to come into contact with the shaft of the photoconductive medium received in the insertion hole, the insertion hole further having a second supporting portion arranged to be spaced apart from the shaft of the photoconductive medium received in the insertion hole. The supporting member may have a wedge portion that, when the supporting member is in the supporting position, becomes positioned between, and comes in contact with both, the shaft of the photoconductive medium and the second supporting portion of the insertion hole so that the shaft of the photoconductive medium is supported by the second supporting portion and the wedge portion of the supporting member.

The first supporting portion of the insertion hole may form a V shape.

The wedge portion of the supporting member may have a tapered leading end portion that becomes narrower closer to an end of the leading end portion.

The outer end portion of the wedge portion of the supporting member that contacts the second supporting portion of the insertion hole may form a first arc that is substantially concentric with a rotational movement of the supporting member. The inner end portion of the wedge portion of the supporting member that contacts the shaft of the photoconductive medium may form a second arc having an arc radius that is substantially the same or greater than the radius of the shaft of the photoconductive medium.

The image forming apparatus may further comprise a handle moveably coupled to the cover. The handle may be configured to receive an external force and to transmit the received external force to the latch.

The image forming apparatus may further comprise an elastic member that elastically biases the supporting member in a direction of moving the supporting member into the supporting position.

The first end of the latch that engages with the main body may includes a locking portion. The main body may include a protrusion arranged to engage with the locking portion of the latch.

The locking portion of the latch may include a guide surface that is slanted with respect to the protrusion of the main body to guide the latch to move in one direction.

According to another aspect of the present disclosure, an image forming apparatus may be provided to include a main body, a developing unit, a cover, a latch and a supporting member. The developing unit may be detachably received in the main body, and may have a photoconductive medium configured to support thereon a visible image. The cover may be pivotably mounted on the main body. The latch may be coupled to the cover in such a manner as to allow a linear movement of the latch, and may have a first end thereof configured to engage a portion of the main body so as to maintain the cover in a position covering the developing unit received in the main body. The supporting member may be rotatably coupled to the cover, and may be rotatable in association with the linear movement of the latch between at least a supporting position at which the supporting member comes into contact with a shaft of the photoconductive medium and a releasing position at which the supporting member is spaced apart from the shaft of the photoconductive medium. The elastic member may elastically bias the supporting member toward the supporting position.

According to yet another aspect of the present disclosure, an image forming apparatus may be provided to include a main body having an opening, a replaceable device detachably received into the main body through the opening, a cover arranged on the main body to be moveable between an open position and a closed position, a latch arranged in the cover to be moveable between a locked position and an unlocked position and a support member coupled to the cover. The replaceable device may have a rotational member configured to rotate about a rotational shaft. The cover may expose the replaceable device received in the opening of the main body when the cover is in the open position, and may close the opening to cover the replaceable device received in the opening of the main body when the cover is in the closed position. The latch may be in an engaging contact with a portion of the main body so as to hold the cover in the closed position when the latch is in the locked position. The cover may be allowed to move to the open position when the latch is in the unlocked position. The support member may be arranged to come into an interfering contact with the latch so as to be moveable in cooperation with the latch between at least a supporting position and a releasing position. The support member may come into contact with the rotational shaft of the rotational member of the replaceable device received in the main body so as to limit a movement of the rotational shaft in a direction substantially perpendicular to the rotational shaft when the support member is in the supporting position, and may be spaced apart from the rotational shaft of the rotating member when the support member is in the releasing position.

BRIEF DESCRIPTION OF THE DRAWINGS

Various aspects of the present disclosure will become apparent and more readily appreciated from the following description of the embodiments, taken in conjunction with the accompanying drawings, in which.

DETAILED DESCRIPTION OF SEVERAL EMBODIMENTS

Figure 1:
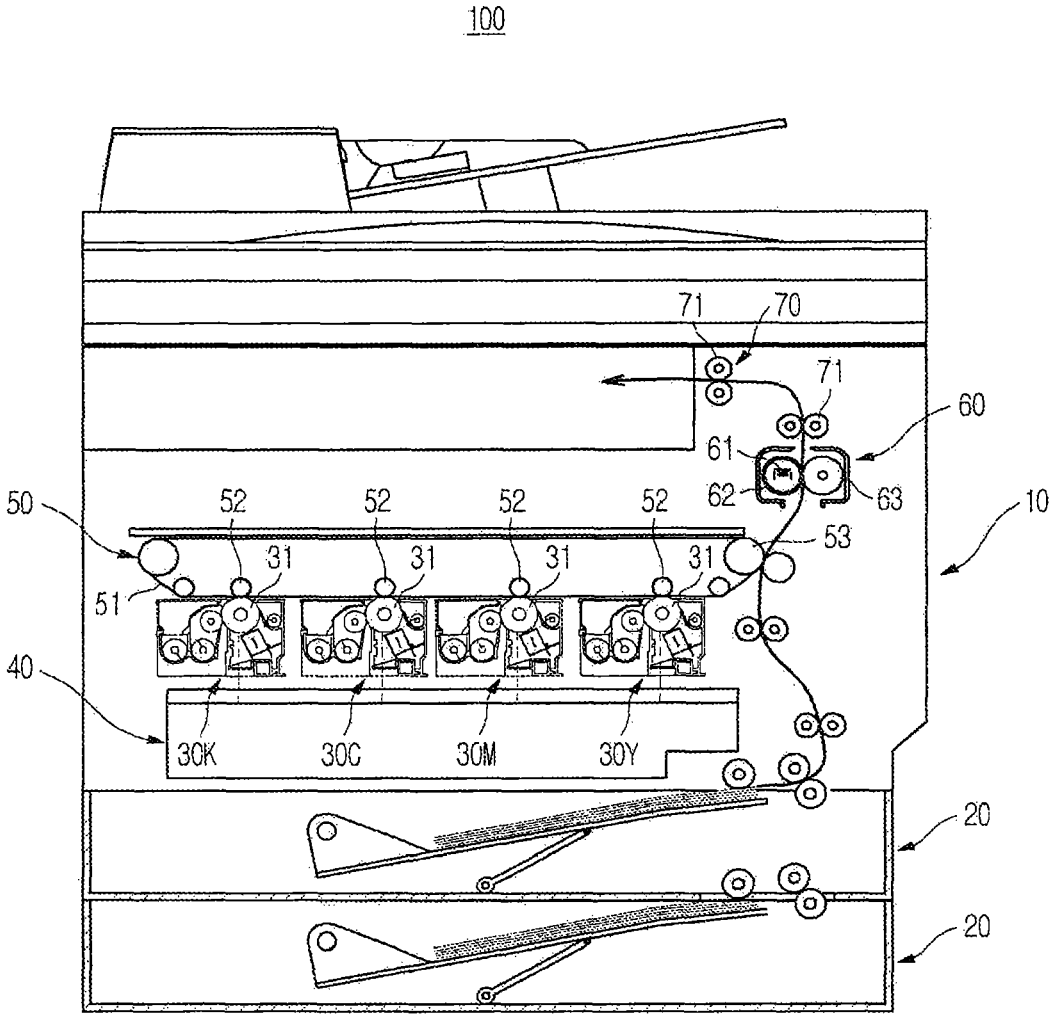
FIG. 1 is a sectional view schematically showing the structure of an image forming apparatus according to an embodiment of the present disclosure.

Reference will be made in detail to several embodiments of the present disclosure, examples of which are illustrated in the accompanying drawings, wherein like reference numerals refer to the like elements throughout.

As shown in FIG. 1, an image forming apparatus according to an embodiment of the present disclosure may comprise a main body 10 defining the overall exterior appearance of the image forming apparatus, a feeding unit 20 that are configured and arranged to store therein a supply of paper P, or other like printing medium, for use by the image forming apparatus, multiple developing units 30K, 30C, 30M and 30Y that form visible images using developer, a laser scanning unit 40 that forms electrostatic latent images on photoconductive mediums 31 of the respective developing units 30K, 30C, 30M and 30Y, a transfer unit 50 that transfers the visible developer images formed on the photoconductive mediums 31 to the paper P, a fixing unit 60 that fixes the transferred developer images onto the paper P and a discharging unit 70 that discharges the paper P, on which the visible images are fixed, outside of the main body 10.

The developing units may form the visible images using the developer. According to an embodiment of the present disclosure, four developing units 30K, 30C, 30M and 30Y respectively storing black, cyan, magenta and yellow developers may be provided. Each developing unit may include a photoconductive medium 31 that functions as an image carrier to hold the visible developer images thereon, and that may allow an electrostatic latent images to be formed thereon by the laser scanning unit 40. The image forming apparatus 100 according to an embodiment may further include a waste developer discharging auger 32 (see, e.g., FIG. 2) provided for the discharge of waste developer generated in the developing units 30K, 30C, 30M and 30Y.

The laser scanning unit 40 may be configured to emit light, e.g., a laser beam, that contains image data to the photoconductive mediums 31 to form thereon the electrostatic latent images.

The transfer unit 50 may comprise an intermediate transfer belt 51 that is configured to receive the visible developer images from the respective photoconductive mediums 31, first transfer rollers 52 arranged to face the photoconductive mediums 31 with the intermediate transfer belt 51 interposed therebetween and a second transfer roller 53 transferring the visible images from the intermediate transfer belt 51 to the paper P. That is, the visible images formed on the photoconductive mediums 31 may be transferred to the intermediate transfer belt 51 by the operations of the first transfer rollers 52, and may in turn be transferred from the intermediate transfer belt 51 to the paper P that is supplied from the feeding unit 20 and that is made to pass between the second transfer roller 53 and the intermediate transfer belt 51.

The fixing unit 60 may comprise a heating roller 62 holding a heater 61 therein and a pressing roller 63 made of an elastic material to bring the paper P into close contact with the heating roller 62, and may cause the visible developer image to be fixed on the paper P by applying thereto heat and/or pressure.

The discharging unit 70 may comprise multiple discharging rollers 71 arranged in sequence to discharge the paper P to the outside of the main body 10 after the developer has been fixed to the paper P by passing the paper through the fixing unit 60.

The developing units 30K, 30C, 30M and 30Y of the image forming apparatus 100 according to an embodiment may be separably mounted on the main body 10. For example, when the developer in the developing units 30K, 30C, 30M and 30Y is used up, the developing units 30K, 30C, 30M and 30Y may be separated from the main body 10, and may be replaced by new ones.

Figure 2:
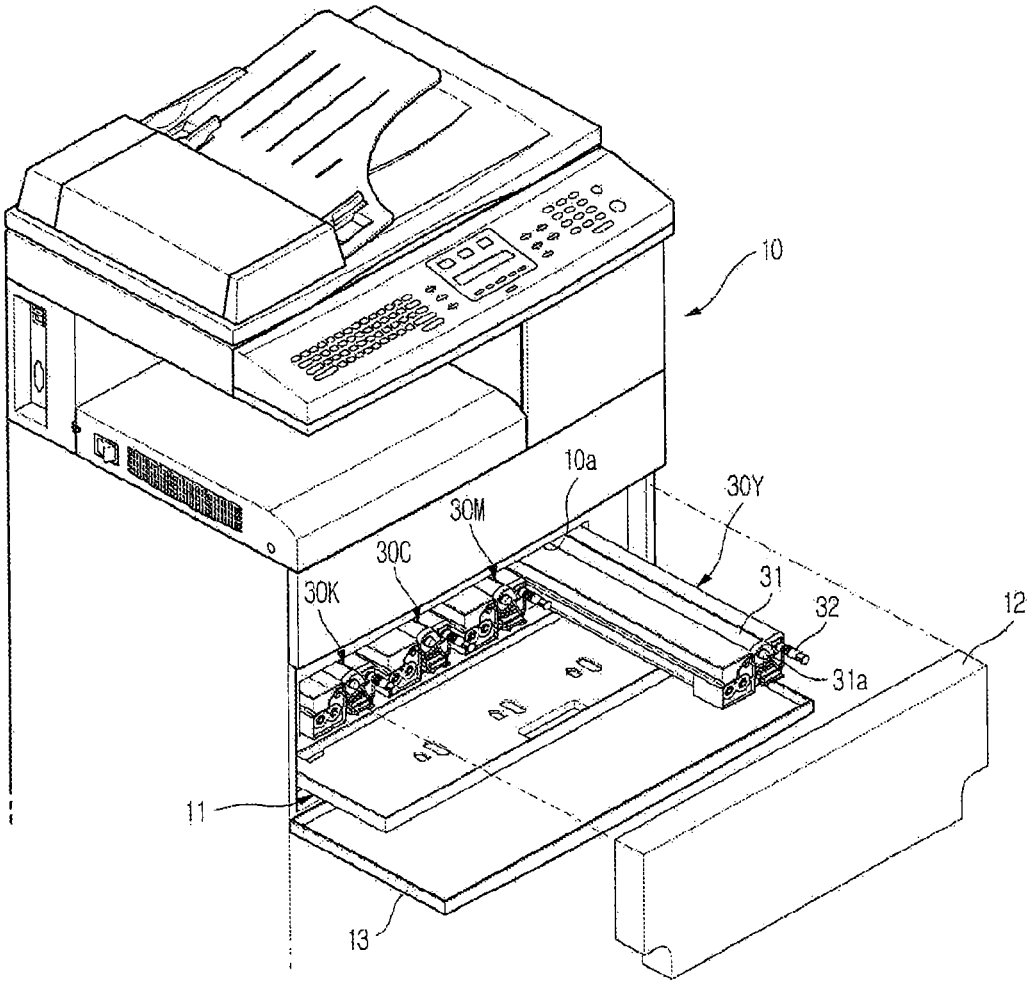
FIG. 2 is a perspective view of an image forming apparatus according to an embodiment of the present disclosure.

To this end, referring to FIG. 2, the main body 10 may be provided with receiving parts 10*a* into which the developing units 30K, 30C, 30M and 30Y may be received, a supporting cover 11 that covers and supports the outer ends of the developing units 30K, 30C, 30M and 30Y received in the receiving parts 10*a*, a waste developer storage 12 that may be disposed at the outer side of the supporting cover 11 to receive and store waste developer generated in the developing units 30K, 30C, 30M and 30Y and an external cover 13 covering an outer side of the waste developer storage 12.

Figure 3:
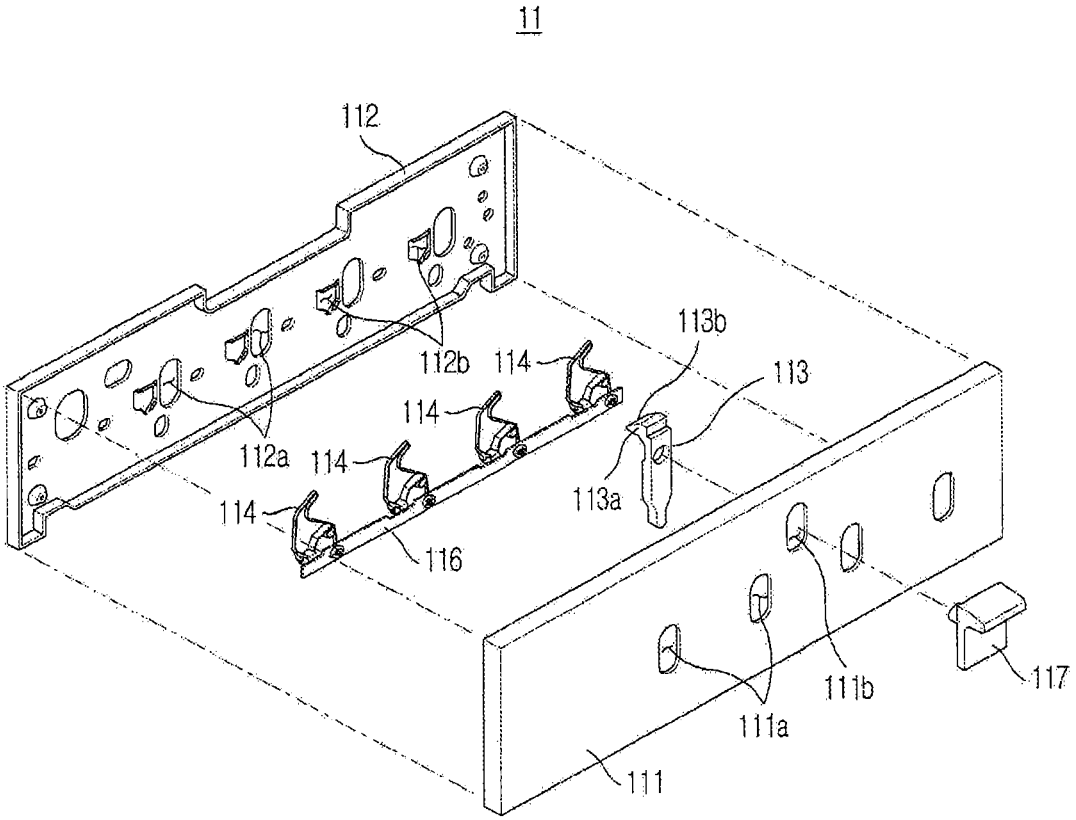
FIG. 3 is an exploded perspective view of a supporting cover employable in an image forming apparatus according to an embodiment of the present disclosure.

The supporting cover 11 may be pivotably mounted on the main body 10, e.g., to pivot about the lower end portion of the supporting cover 11, and may be arranged to cover and to support the outer ends of the developing units 30K, 30C, 30M and 30Y. As shown in FIG. 3, the outer side of the supporting cover 11 may include an outer frame 111 and an inner frame 112 coupled to each other.

Figure 4:
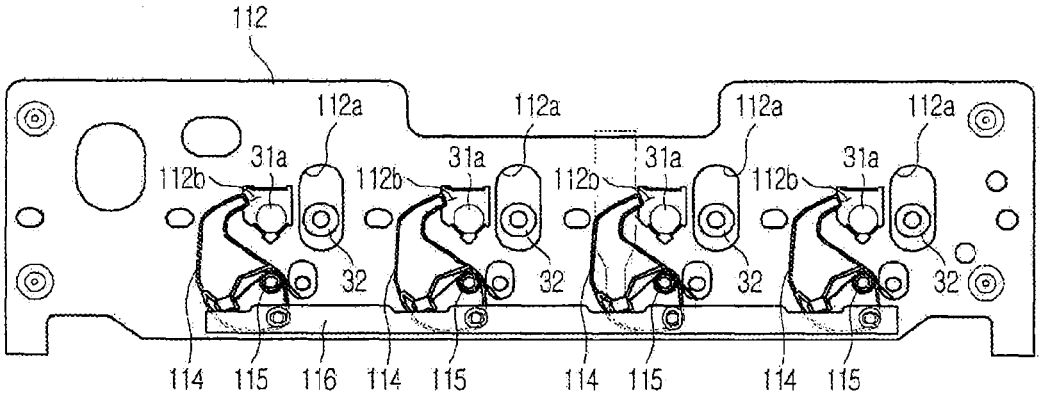
FIGS. 4 and 5 are front views showing the operation of a supporting member employable in an image forming apparatus according to an embodiment of the present disclosure.

The outer frame 111 and the inner frame 112 may respectively include first penetration holes 111*a* and second penetration holes 112*a* through which the ends of the waste developer discharging auger 32 may be inserted. The supporting cover 11 may include a latch 113 mounted on the inner frame 112 to be movable vertically, that is along the upward and downward directions. An upper end of the latch 113 may protrude upward so as to be capable of being engaged with the main body 10 such that the supporting cover 11 maintains the developing units 30K, 30C, 30M and 30Y in the covered state. The supporting cover 11 may further include supporting members 114 rotatably mounted to the inner frame 112 to respectively support shafts 31*a* of the photoconductive mediums 31 and elastic members 115 (see FIG. 4), each of which may comprise a torsion spring elastically supporting each of the supporting members 114 so that the respective corresponding supporting member 114 may return to its initial position when an external force acting to rotate the supporting member 114 is released.

Figure 6:
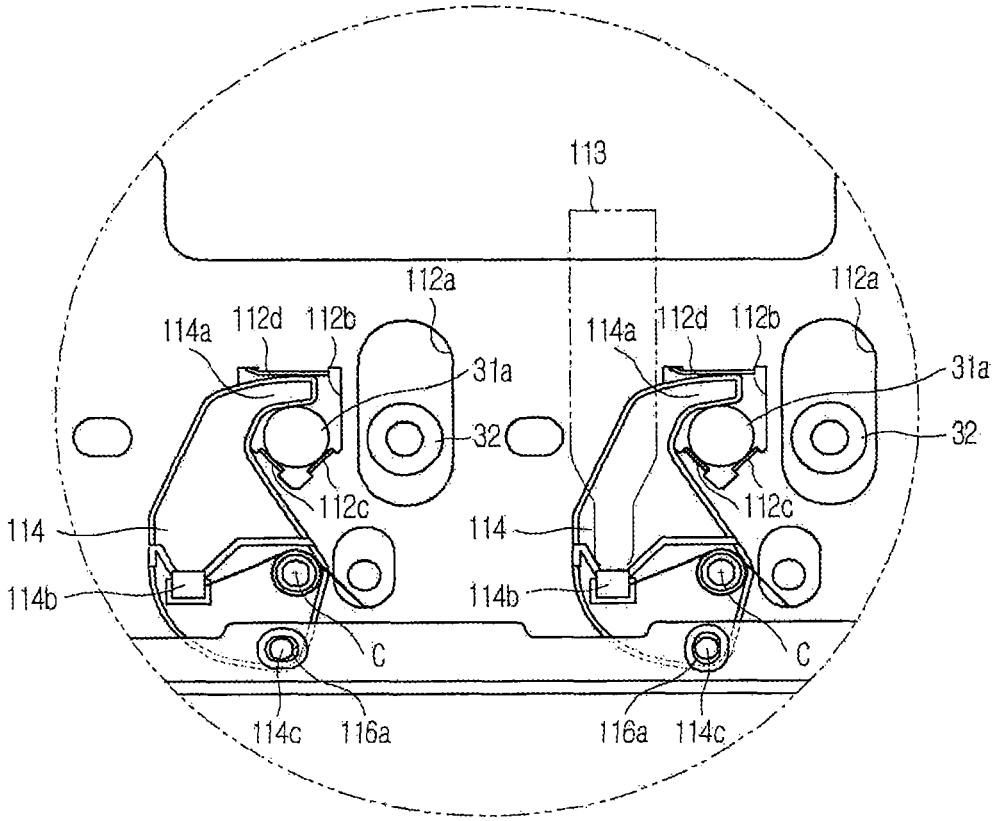
FIG. 6 is a front view of the supporting member employable in an image forming apparatus according to an embodiment of the present disclosure.
Figure 7:
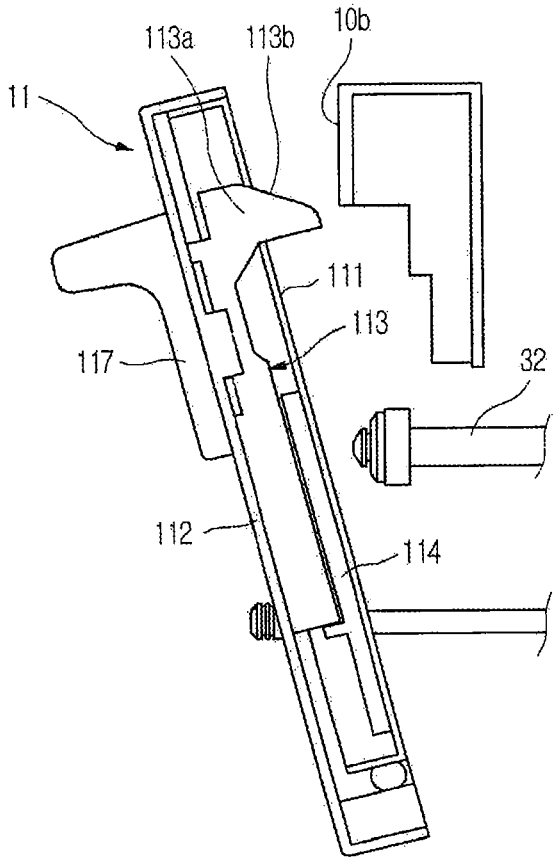
FIG. 7 and FIG. 8 are front views showing the operation of a latch employable in an image forming apparatus according to the embodiment of the present disclosure.

The latch 113 may comprise a locking part 113*a* formed at an upper end thereof for engagement with the main body 10. Correspondingly, the main body 10 may include a locking protrusion 10*b* (see FIG. 7) capable of engaging with the locking part 113*a* of the latch 113. The locking part 113*a* may include a guide surface 113*b* formed to be slanted with respect to the locking protrusion 10*b* to guide the latch 113 when moving downward by an external force operating to close the supporting cover 11. A lower end of the latch 113 may be supported by the supporting member 114 so that the external force imparted to the latch 113 may be transmitted to the supporting member 114, and, accordingly, the supporting member 114 may be rotated in association with the upward and downward movements of the latch 113. As shown in FIG. 6, the supporting member 114 may include a transmission part 114*b* protruding from the supporting member 114 to support the rotation of the lower end of the latch 113 and to receive the external force from the latch 113.

The inner frame 112 may comprise insertion holes 112*b* that receive the shafts 31*a* of the photoconductive mediums 31 into the supporting cover 11, and each insertion hole 1126 may comprise a pair of first supporting portions 112*c* (see FIG. 6) arranged in a V-shape configuration at both sides of a lower portion thereof to support the shaft 31*a* of the photoconductive medium 31 and a second supporting portion 112*d* (see FIG. 6) disposed at an upper portion thereof to be spaced apart from the shaft 31*a* of the photoconductive medium 31. The supporting member 114 may include a wedge part 114*a* that extends in a circumferential direction with respect to the rotational direction of the supporting member 114 so that the wedge part 114*a* is able to enter between the shaft 31*a* and the second supporting portion 112*d* according to the rotation of the supporting member 114 so that the shaft 31*a* may be indirectly supported by the second supporting portion 112*d*. The shape of the wedge part 14*a* may be narrowed toward its leading end. An outer end portion of the wedge part 114*a* supported by the second supporting portion 112*d* may have an arc shape, the center of which may correspond to the center of rotation of the supporting member 114, for example. An inner end portion of the wedge part 114*a* supported by the shaft 31*a* of the photoconductive medium 31 may have an arc shape with substantially the same or a greater radius than the shaft 31*a* of the photoconductive medium 31. Therefore, the lower portion of the shaft 31*a* of the photoconductive medium 31 may be supported by the first supporting portions 112*c* while the upper portion thereof may be indirectly supported by the second supporting portion 112*d* through the wedge part 114*a* of the supporting member 114. Accordingly, rotation of the photoconductive medium 31 may be stably performed.

Referring to FIG. 3, the outer frame 111 may comprise a handle 117 mounted thereto to be movable in the upward and downward directions to transmit the external force from a user to the latch 113. The outer frame 111 may also have a guide hole 111*b* elongated in the vertical direction so that the handle 117 may be mounted to move upwardly and downwardly therein.

In addition, according to an embodiment of the present disclosure, multiple supporting members 114 may be provided to support the photoconductive mediums 31 of the developing units 30K, 30C, 30M and 30Y, respectively. A gear member 116 may be connected to the lower ends of the supporting members 14 to enable the supporting members 14 to operate in association with one another. The lower end of the latch 113 may be supported by at least one of the supporting members 114. Therefore, as the latch 113 moves upward and downward, the supporting member 114 supporting the lower end of the latch 113 may have the external force from the latch 113 directly applied, and may thereby be rotated. Accordingly, the supporting members 114 may support the shafts 31*a* of the photoconductive mediums 31 of the respective developing units 30K, 30C, 30M and 30Y, almost simultaneously.

As shown in FIG. 6, the supporting members 114 may each comprise a hinge projection 114*c* rotatably mounted on the gear member 116 whereas the gear member 116 comprises hinge holes 116*a* for receiving the hinge projections 114*c* of the respective supporting members 14. The hinge hole 116*a* mounting the supporting member 114 that directly receives the external force from the latch 113 may have a relatively greater width than the diameter of the hinge projection 114*c*. The other hinge holes 116*a* mounting the supporting members 114 that receive the external force from the latch 113 through the gear member 116 may have relatively greater widths than the diameter of the hinge projection 114*c* with respect to the length direction of the gear member 116. This is to enable the respective supporting members 114 to operate somewhat independently, considering the positional tolerances of the shafts 31*a* of the photoconductive mediums 31 of the respective developing units 30K, 30C, 30M and 30Y.

Hereinafter, several embodiments of the operation of the above-structured image forming apparatus 100 will be described with reference to the drawings.

Figure 8:
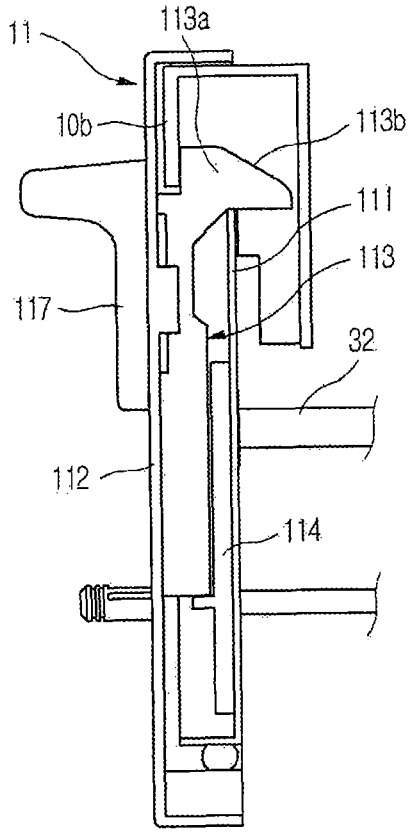

When a user exerts an external force on the handle 117 to move the handle 117 in a state where the upper end of the latch 113 is engaged with the locking protrusion 10*b* (as shown in FIG. 8), the latch 113 may be moved downward along with the handle 117, thereby having the upper end of the latch 113 released from the locking protrusion 10*b*. As the latch 113 moves downward, the external force is transmitted to the supporting member 114 through the latch 113 so that the supporting member 114 is rotated from the position shown in FIG. 5 to the position shown in FIG. 4. According to the rotation of the supporting member 114, the wedge part 114*a* may escape from between the shaft 31*a* and the second supporting portion 112*d*. Because the supporting members 114 are interconnected through the gear member 116, and because the supporting members 114 may thus rotate together, the shafts 31*a* of the photoconductive mediums 31 of each of the developing units 30K, 30C, 30M and 30Y may be released from the supported state. When the handle 17 is then pulled forward by the external force, the supporting cover 11 may be pivoted by the lower end thereof, and may thus become open.

That is, the user may be able to operate the latch 13 and the supporting members 114 by pushing the handle 117 downward, and may be able to open the supporting cover 11 simply by pulling the pushed handle 117 forward. Thus, the developing units 30K, 30C, 30M and 30Y may be separated from the main body 10 in a simple manner.

Figure 5:
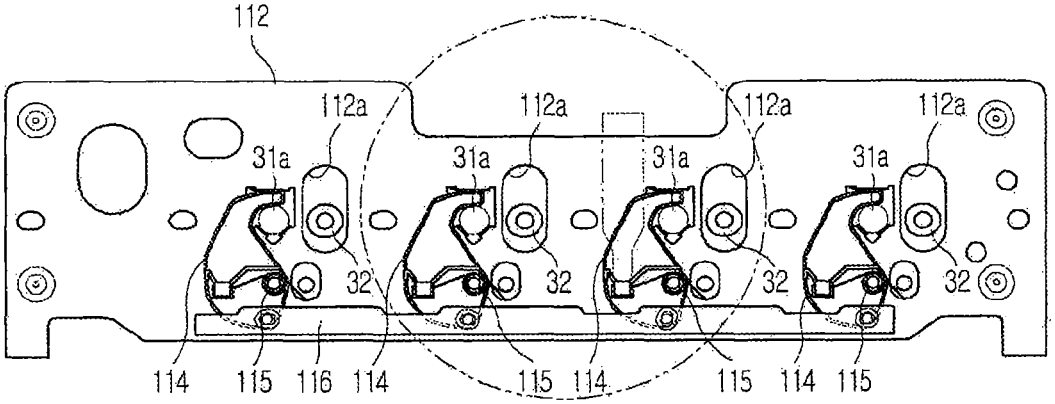

During the mounting of the developing units 30K, 30C, 30M and 30Y, when an external force is applied to the supporting cover 11, thereby rotating the supporting cover 11 so that the outer ends of the developing units 30K, 30C, 30M and 30Y are covered by the supporting cover 11, the guide surface 113*b* of the locking part 113*a* formed at the upper end of the latch 113 advances (from the position shown in FIG. 7) and comes into contact with the locking protrusion 10*b*. Part of the external force operating to close the supporting cover 11 may be diverted by the guide surface 113*b*, and may be used to move the latch 113 downward. As the latch 113 moves downward, the supporting member 114 may be rotated in a certain direction to the position shown in FIG. 4. Such a rotation of the supporting member 114 may elastically deform the elastic member 115, which when the external force imparted on the handle 117 is released, elastically biases the supporting member 114 to rotate in the opposite direction by the recovery force of the elastic member 115 so that the supporting member 114 returns to its initial position as shown in FIG. 5. When the outer ends of the developing units 30K, 30C, 30M and 30Y are closed by the supporting cover 11, the shaft 31*a* of each of the photoconductive mediums 31 may protrude into the supporting cover 11 through the corresponding insertion hole 112*b*. Therefore, while the supporting member 114 returns to the initial position, the wedge part 114*a* of the supporting member 114 may enter between the shaft 31*a* of the photoconductive medium 31 and the second supporting portion 112*d* such that the shaft 31*a* may be supported by the second supporting portion 112*d* through the wedge part 114*a* acting as an intermediary. Furthermore, because the supporting member 114 moves the latch 113 upward while rotating to return to the initial position, the locking part 113*a* formed at the upper end of the latch 113 may enter into the locking protrusion 10*b*, thereby coming into engagement with the locking protrusion 10*b* as shown in FIG. 8. Accordingly, the supported state of the outer ends of the developing units 30K, 30C, 30M and 30Y by the supporting cover 11 may be maintained by the latch 113.

As is apparent from the above description, since a supporting member operates in association with a latch in an image forming apparatus according to the embodiment of the present disclosure, the latch and the supporting member may be operated to move in cooperation with each other, thereby enabling a convenient opening and closing of the supporting cover. As a consequence, it may be easier to separate the developing unit from the main body of the image forming apparatus.

While the disclosure has been particularly shown and described with reference to several embodiments thereof with particular details, it will be apparent to one of ordinary skill in the art that various changes may be made to these embodiments without departing from the principles and spirit of the invention, the scope of which is defined in the following claims and their equivalents.

The invention claimed is:

1. An image forming apparatus, comprising:

a main body;

at least one developing unit detachably received in the main body;

a cover mounted on the main body;

a latch configured to maintain the cover in a covering position at which position the cover covers the at least one developing unit received in the main body; and at least one supporting member to support a shaft of the developing unit in association with a movement of the latch.

2. The image forming apparatus according to claim 1, wherein the supporting member is rotatably mounted on the cover and is configured to rotate between a supporting position at which position the supporting member comes into a supporting contact with a shaft and a releasing position at which position the at least one supporting member is spaced apart from the shaft.

3. The image forming apparatus according to claim 2, wherein the at least one developing unit comprises a plurality of developing units each received in the main body and each having a respective corresponding shaft, and wherein the at least one supporting member comprises a plurality of supporting members each moveably coupled to the cover and each configured to move into the supporting position so as to support the shaft corresponding to a respective associated one of the plurality of developing units.

4. The image forming apparatus according to claim 3, further comprising a gear member coupled to the plurality of supporting members so that the supporting members move in association with movements of one another.

5. The image forming apparatus according to claim 4, wherein each supporting member comprises a hinge projection protruding from the supporting member, and wherein the gear member defines a plurality of hinge holes, at least one for each supporting member, into which the hinge projection of each of the plurality of supporting members is rotatably received.

6. The image forming apparatus according to claim 3, wherein the first end of the latch that engages with the main body includes a locking portion, and wherein the main body includes a protrusion arranged to engage with the locking portion of the latch.

7. The image forming apparatus according to claim 6, wherein the locking portion of the latch includes a guide surface that is slanted with respect to the protrusion of the main body to guide the latch to move in one direction.

8. The image forming apparatus according to claim 2, further comprising: an elastic member that elastically biases the supporting member in a direction of moving the supporting member into the supporting position.

9. The image forming apparatus according to claim 2, wherein the latch is movable substantially linearly, and having a first end to engage with the main body and a second end opposite the first end thereof capable of coming into an interfering contact with the at least one supporting member such that the movement of the latch causes the at least one supporting member to rotate.

10. The image forming apparatus according to claim 9, wherein the second end of the latch comes into contact with a first one of the plurality of supporting members, wherein a first one of the plurality of hinge holes of the gear member that receives the hinge projection of the first one of the plurality of supporting members has a width along a direction of the movement of the latch greater than a diameter of the hinge projection of the first one of the plurality of supporting members, and wherein remaining ones of the plurality of hinge holes of the gear member have respective widths along a longitudinal direction of the gear member greater than respective diameters of the hinge projections of respective associated ones of the plurality of supporting members.

11. The image forming apparatus according to claim 1, wherein the cover defines an insertion hole into which the shaft is received, the insertion hole having a first supporting portion arranged to come into contact with the shaft received in the insertion hole, the insertion hole further having a second supporting portion arranged to be spaced apart from the shaft received in the insertion hole, and wherein the supporting member has a wedge portion that, when the supporting member is in the supporting position, becomes positioned between, and comes in contact with both, the shaft and the second supporting portion of the insertion hole so that the shaft is supported by the second supporting portion and the wedge portion of the supporting member.

12. The image forming apparatus according to claim 11, wherein the first supporting portion of the insertion hole forms a V shape.

13. The image forming apparatus according to claim 11, wherein the wedge portion of the supporting member has a tapered leading end portion that becomes narrower closer to an end of the leading end portion.

14. The image forming apparatus according to claim 13, wherein an outer end portion of the wedge portion of the supporting member that contacts the second supporting portion of the insertion hole forms a first arc that is substantially concentric with a rotational movement of the supporting member, and wherein an inner end portion of the wedge portion of the supporting member that contacts the shaft forms a second arc having an arc radius that is substantially the same or greater than a radius of the shaft.

15. The image forming apparatus according to claim 1, further comprising:

a handle moveably coupled to the cover, the handle being configured to receive an external force and to transmit the received external force to the latch.

16. The image forming apparatus according to claim 1, wherein the at least one developing unit having a photoconductive medium configured to support thereon a visible image, and wherein the shaft is a shaft of the photoconductive medium.

17. The image forming apparatus according to claim 1, wherein the cover is pivotably mounted on the main body.

18. An image forming apparatus, comprising:

a main body;

at least one developing unit detachably received in the main body;

a cover pivotably mounted on the main body and to rotate between a covering position at which position the cover covers the at least one developing unit received in the main body and an opening position at which the position the cover is spaced apart from the at least one developing unit received in the main body;

at least one supporting member rotatably coupled to the cover and configured to come into contact with a shaft of the at least one developing unit when the cover is in the covering position.

19. The image forming apparatus according to claim 18, wherein the at least one developing unit comprises a plurality of developing units each received in the main body and each having a respective corresponding shaft, wherein the supporting member comprises a plurality of supporting members each rotatably coupled to the cover and each configured to rotate into the supporting position so as to support the shaft corresponding to a respective associated one of the plurality of developing units.

20. The image forming apparatus according to claim 19 further comprising a gear member coupled to each of the plurality of supporting members such that the supporting members move in association with one another.

21. The image forming apparatus according to claim 18, further comprises a latch coupled to the cover in such a manner as to allow a linear movement of the latch and is configured to maintain the cover in the covering position; and wherein the at least one supporting member is rotate between a supporting position at which the supporting member comes into contact with the shaft and a releasing position at which the supporting member is spaced apart from the shaft in association with the linear movement of the latch.

22. The image forming apparatus according to claim 21, wherein the cover defines an insertion hole into which the shaft is received, the insertion hole having a first supporting portion arranged around a first portion of the insertion hole so as to come into contact with the shaft received in the insertion hole, the insertion hole further having a second supporting portion arranged around a second portion of the insertion hole so as to be spaced apart from the shaft received in the insertion hole, and wherein the supporting member has a wedge portion that, when the supporting member is in the supporting position, becomes positioned between, and comes in contact with both, the shaft and the second supporting portion of the insertion hole so that the shaft is supported by the second supporting portion and the wedge portion of the supporting member.

23. An image forming apparatus, comprising:

a main body having an opening;

at least one replaceable device detachably received into the main body through the opening, the at least one replaceable device having a rotational member to rotate about a rotational shaft;

a cover arranged on the main body to be moveable between an open position and a closed position, the cover exposing the at least one replaceable device received in the opening of the main body when the cover is in the open position, the cover closing the opening to cover the at least one replaceable device received in the opening of the main body when the cover is in the closed position;

a latch arranged in the cover to be moveable between a locked position and an unlocked position, the latch being in an engaging contact with a portion of the main body to hold the cover in the closed position when the latch is in the locked position, the cover being allowed to move to the open position when the latch is in the unlocked position;

at least one support member coupled to the cover, the at least one support member arranged to come into an interfering contact with the latch to be moveable in cooperation with the latch between at least a supporting position and a releasing position, wherein the support member comes into contact with the rotational shaft of the rotational member of the at least one replaceable device received in the main body to limit a movement of the rotational shaft in a direction substantially perpendicular to the rotational shaft when the at least one support member is in the supporting position, the at least one support member being spaced apart from the rotational shaft of the rotating member when the support member is in the releasing position.

24. The image forming apparatus of claim 23, further comprising:

an elastic member arranged in the cover, the elastic member elastically biasing the at least one support member toward the supporting position.

25. The image forming apparatus of claim 23, further comprising:

a handle arranged on the cover in such a manner to be moveable by a force received from a source external to the main body, the handle being coupled to the latch so as to cause the latch to move together with the handle.

* * * * *

UNITED STATES PATENT AND TRADEMARK OFFICE

CERTIFICATE OF CORRECTION

PATENT NO. : 8,774,678 B2
APPLICATION NO. : 13/659275
DATED : July 8, 2014
INVENTOR(S) : Kwoang Joe Seorl et al.

It is certified that error appears in the above-identified patent and that said Letters Patent is hereby corrected as shown below:

In the Claims

Column 10, Line 65, Claim 18, after “which” delete “the”.

Column 11, Line 22, Claim 21, delete “rotate” and insert -- rotated --, therefor.

Signed and Sealed this
Fourth Day of November, 2014

Michelle K. Lee

Michelle K. Lee
*Deputy Director of the United States Patent and Trademark Office*